US012690619B2

(12) United States Patent
Spratley et al.

(10) Patent No.: US 12,690,619 B2
(45) Date of Patent: Jul. 28, 2026

(54) AEROSOL PROVISION DEVICE

(71) Applicant: Nicoventures Trading Limited, London (GB)

(72) Inventors: Jon Peter Frederick Spratley, Cambridgeshire (GB); Francesca Alys Stephens, Cambridgeshire (GB); Adam Robinson, Cambridgeshire (GB); Simon James Copley, Cambridgeshire (GB); Daniel Jerrad Moss, Cambridgeshire (GB); Andy Finch, Cambridgeshire (GB)

(73) Assignee: Nicoventures Trading Limited, London (GB)

( * ) Notice: Subject to any disclaimer, the term of this patent is extended or adjusted under 35 U.S.C. 154(b) by 444 days.

(21) Appl. No.: 18/040,715

(22) PCT Filed: Aug. 4, 2021

(86) PCT No.: PCT/EP2021/071798
§ 371 (c)(1),
(2) Date: Feb. 6, 2023

(87) PCT Pub. No.: WO2022/029191
PCT Pub. Date: Feb. 10, 2022

(65) Prior Publication Data

US 2023/0309626 A1 Oct. 5, 2023

(30) Foreign Application Priority Data

Aug. 5, 2020 (GB) ..... 2012179

(51) Int. Cl.
*A24F 40/485* (2020.01)
*A24F 40/42* (2020.01)

(52) U.S. Cl.
CPC ..... *A24F 40/485* (2020.01); *A24F 40/42* (2020.01)

(58) Field of Classification Search
CPC ..... A24F 40/42; A24F 40/485
See application file for complete search history.

(56) References Cited

U.S. PATENT DOCUMENTS 9,220,304 B2 * 12/2015 Greim ..... H05B 3/02
11,140,920 B2 * 10/2021 Eweidah ..... A24F 40/90
(Continued)

FOREIGN PATENT DOCUMENTS

WO 2015/180071 A1 12/2015
WO 2019/202048 A1 10/2019
WO 2020/104490 A1 5/2020

OTHER PUBLICATIONS

International Search Report and Written Opinion received for PCT Patent Application No. PCT/EP2021/071798, mailed on Dec. 9, 2021, 16 pages.

*Primary Examiner* — Russell E Sparks
(74) *Attorney, Agent, or Firm* — MERCHANT & GOULD P.C.

(57) ABSTRACT

The present application relates to an aerosol provision device. The device has a chamber configured to receive a consumable including aerosol-generating material, a body including a portion of the chamber, a mouthpiece through which aerosol generated from the aerosol-generating material is drawn by a user of the device, and a barrier discrete from the mouthpiece and movably coupled to the body. When the device is in a closed state, the barrier inhibits ingress of the consumable into the portion of the chamber and egress of the consumable from the portion of the chamber, and, when the device is in an open state, the barrier
(Continued)

allows ingress of the consumable into the portion of the chamber and egress of the consumable from the portion of the chamber.

18 Claims, 9 Drawing Sheets

(56) References Cited

U.S. PATENT DOCUMENTS

| | | | | |
|---|---|---|---|---|
| 11,305,076 | B2 * | 4/2022 | Emmett | A24F 40/485 |
| 12,256,787 | B2 * | 3/2025 | Prestia | A24F 40/95 |
| 2015/0157053 | A1 * | 6/2015 | Mayor | A24F 40/485 131/329 |
| 2019/0254345 | A1 | 8/2019 | Hepworth et al. | |
| 2020/0120989 | A1 | 4/2020 | Danek | |
| 2020/0221767 | A1 | 7/2020 | Emmett et al. | |

* cited by examiner

AEROSOL PROVISION DEVICE

PRIORITY CLAIM

The present application is a National Phase entry of PCT Application No. PCT/EP2021/071798, filed Aug. 4, 2021, which claims priority from GB Application No. 2012179.4, filed Aug. 5, 2020, each of which hereby fully incorporated herein by reference.

TECHNICAL FIELD

The present disclosure relates to aerosol provision devices, aerosol provision systems comprising an aerosol provision device, and methods of arranging an aerosol provision device.

BACKGROUND

Smoking articles such as cigarettes, cigars and the like, burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect provides an aerosol provision device. The aerosol provision device is for generating an inhalable medium, for example aerosol. The aerosol provision device comprises a chamber configured to receive a consumable comprising aerosol-generating material. The aerosol provision device comprises a body comprising at least one portion of the chamber. The aerosol provision device comprises a mouthpiece through which aerosol generated from the aerosol-generating material is drawn by a user of the aerosol provision device. The aerosol provision device comprises a barrier discrete from the mouthpiece and movably coupled to the body. The aerosol provision device is configured such that when the aerosol provision device is arranged in a closed state, the barrier inhibits ingress of the consumable into the at least one portion of the chamber and egress of the consumable from the at least one portion of the chamber, and, when the aerosol provision device is arranged in an open state, the barrier allows ingress of the consumable into the at least one portion of the chamber and egress of the consumable from the at least one portion of the chamber.

In some embodiments, the barrier is movable with respect to the mouthpiece, such that, when the aerosol provision device is arranged in the closed state, the barrier is in a first position with respect to the mouthpiece, and, when the aerosol provision device is arranged in the open state, the barrier is in a second, different position with respect to the mouthpiece.

In some embodiments, the mouthpiece is removably attachable to the barrier.

In some embodiments, the barrier comprises another portion of the chamber.

In some embodiments, the barrier is rotationally moveable relative to the body.

In some embodiments, the aerosol provision device comprises a buccal end comprising the mouthpiece wherein an axis of rotation B of the barrier is located away from the buccal end of the aerosol provision device.

In some embodiments, an axis of rotation is substantially parallel to a longitudinal direction of the aerosol provision device.

In some embodiments, the barrier is translationally moveable relative to the body. In some embodiments, the translational motion comprises rectilinear motion. In some embodiments, the translational motion comprises curvilinear motion.

In some embodiments, the barrier is helically moveable relative to the body.

In some embodiments, the aerosol provision device comprises a guide to guide movement of the barrier relative to the body in a predetermined manner. In some embodiments, the guide comprises a pivot. In some embodiments, the guide comprises a track and a runner configured to move along the track.

In some embodiments, the aerosol provision device comprises a driving mechanism configured to drive relative movement of the barrier and body.

In some embodiments, the aerosol provision device comprises a damping mechanism configured to control at least a portion of relative movement of the barrier and body.

In some embodiments, the barrier is a flexible member.

In some embodiments, the barrier comprises an opening through which at least one portion of the body is configured to pass during movement of the aerosol provision device between the closed state and the open state. In some embodiments, the opening is arranged in an end of the barrier. In some embodiments, the opening is arranged in a side of the barrier.

In some embodiments, the barrier comprises an internal space in communication with the opening, wherein the internal space is configured to receive the at least one portion of the body.

In some embodiments, the barrier itself is configured to block the opening when the aerosol provision device is arranged in the closed state.

In some embodiments, the body is configured to block the opening when the aerosol provision device is arranged in the closed state.

In some embodiments, the aerosol provision device comprises a longitudinal direction, wherein relative movement of the barrier and body is substantially parallel to the longitudinal direction.

In some embodiments, the aerosol provision device comprises a width direction and a depth direction, wherein the relative movement is substantially parallel to the width direction or the depth direction.

In some embodiments, the barrier comprises a first part and second part that are movable relative each other.

In some embodiments, the closed state the barrier is configured to visually conceal at least a portion of the consumable from the user when the consumable is arranged in the at least one portion of the chamber.

In some embodiments, relative movement of the barrier and body is achieved by overcoming a first resistance to a relatively low force and then a second resistance to a relatively high force.

According to a second aspect, there is provided an aerosol provision system comprising an aerosol provision device according to the first aspect and a consumable comprising aerosol-generating material, the consumable configured for receipt in the chamber of the aerosol provision device. In use, the device is configured to generate an aerosol from the aerosol-generating material.

According to a third aspect there is provided a method of arranging the aerosol provision device according to the first aspect. The method comprises arranging the aerosol provision device in the open state by moving the barrier and the body with respect to each other to allow ingress of the consumable into the at least one portion of the chamber and egress of the consumable from the at least one portion of the chamber. The method comprises arranging the aerosol provision device in the closed state by moving the barrier and the body with respect to each other to inhibit the ingress and egress of the consumable.

Further features and advantages of the disclosure will become apparent from the following description of various embodiments, given by way of example only, which is made with reference to the accompanying drawings.

BRIEF DESCRIPTION OF THE DRAWINGS

Embodiments of the disclosure will now be described, by way of example only, with reference to accompanying drawings, in which.

DETAILED DESCRIPTION

Figure 1A:
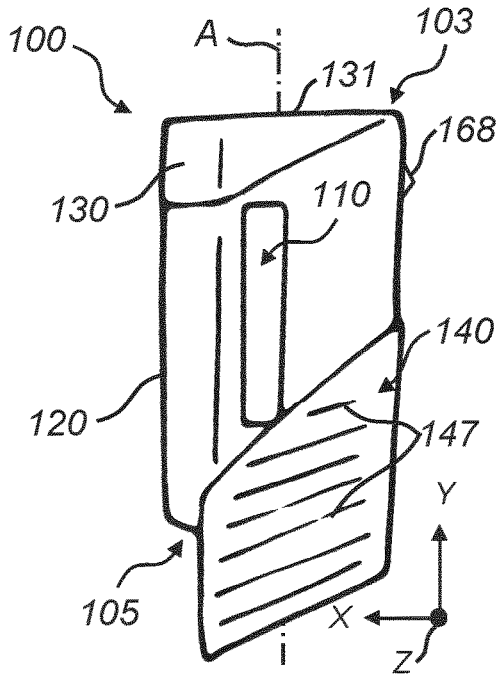
FIGS. 1*a* and 1*b* each show a front view of an aerosol provision device.

The present disclosure relates to aerosol provision devices, such as non-combustible aerosol provision devices, and to aerosol provision systems, such as non-combustible aerosol provision systems. According to the present disclosure, a "non-combustible" aerosol provision device is one where a constituent aerosol-generating material comprised by a consumable for receipt by a chamber of the aerosol provision device (or component thereof) is not combusted or burned in order to facilitate delivery of the aerosol-generating material to a user. In some embodiments, the aerosol provision system, such as the non-combustible aerosol provision system, comprises an aerosol provision device, such as a non-combustible aerosol provision device, and a consumable for use with the aerosol provision device, the consumable comprising an aerosol-generating material.

In some embodiments, the non-combustible aerosol provision system is a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Aerosol-generating material is a material that is capable of generating aerosol, for example when heated, irradiated or energized in any other way. Aerosol-generating material may, for example, be in the form of a solid, liquid or gel which may or may not contain an active substance and/or flavorants. The aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some cases, the aerosol-generating material comprises from about 50 wt %, 60 wt % or 70 wt % of amorphous solid, to about 90 wt %, 95 wt % or 100 wt % of amorphous solid. In some cases, the aerosol-generating material consists of amorphous solid.

The aerosol-generating material may comprise one or more active substances and/or flavors, one or more aerosol-former materials, and optionally one or more other functional materials.

In some embodiments, a substance to be delivered by the aerosol provision device may be an aerosol-generating material which may comprise an active constituent, a carrier constituent and optionally one or more other functional constituents.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use.

The heater may, for example, comprise combustible material, a material heatable by electrical conduction, or a susceptor.

In some embodiments, the consumable for use with the aerosol provision device may comprise aerosol-generating material or an area for receiving aerosol-generating material. The area for receiving aerosol-generating material may be a storage area for storing aerosol-generating material. For example, the storage area may be a reservoir. In some embodiments, the area for receiving aerosol-generating material may be separate from, or combined with, an aerosol generating area.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision device may comprise an area for receiving the consumable, an aerosol generator, an aerosol generation area, a housing, a mouthpiece, a filter and/or an aerosol-modifying agent.

A user may insert the consumable into the aerosol provision device before aerosol is produced, which the user subsequently inhales. The consumable may be, for example, of a predetermined or specific size that is configured to be placed within a chamber, such as a heating chamber, of the device which is sized to receive the consumable.

An aerosol-modifying agent is a substance, typically located downstream of the aerosol generation area, that is configured to modify the aerosol generated, for example by changing the taste, flavor, acidity or another characteristic of the aerosol. The aerosol-modifying agent may be provided in an aerosol-modifying agent release component, that is operable to selectively release the aerosol-modifying agent.

The aerosol-modifying agent may, for example, be an additive or a sorbent. The aerosol-modifying agent may, for example, comprise one or more of a flavorant, a colorant, water, and a carbon adsorbent. The aerosol-modifying agent may, for example, be a solid, a liquid, or a gel. The aerosol-modifying agent may be in powder, thread or granule form. The aerosol-modifying agent may be free from filtration material.

In some embodiments, the substance to be delivered may comprise one or more active constituents, one or more flavors, one or more aerosol-former materials, and/or one or more other functional materials. The one or more other functional materials may comprise one or more of pH regulators, coloring agents, preservatives, binders, fillers, stabilizers, and/or antioxidants.

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy. The aerosol generator may be provided as a permanent part of the aerosol provision device.

Apparatus is known that heats aerosol-generating material to volatilize at least one component of the aerosol-generating material, typically to form an aerosol which can be inhaled, without burning or combusting the aerosol-generating material. Such apparatus is sometimes described as an "aerosol generating device", an "aerosol provision device", a "heat-not-burn device", a "tobacco heating product device" or a "tobacco heating device" or similar. Similarly, there are also so-called e-cigarette devices, which typically vaporize an aerosol-generating material in the form of a liquid, which may or may not contain nicotine. The aerosol-generating material may be in the form of or be provided as part of a rod, cartridge or cassette or the like which can be inserted into the apparatus.

Interaction by a user with the aerosol provision device comprises physically adjusting the aerosol provision device to a state suitable for the usage session. The user will contact a consumable when inserting and removing the consumable. Some embodiments provide aerosol provision devices and aerosol provision systems, that offer improved setup functionality and/or improved cleanliness.

Figure 1B:
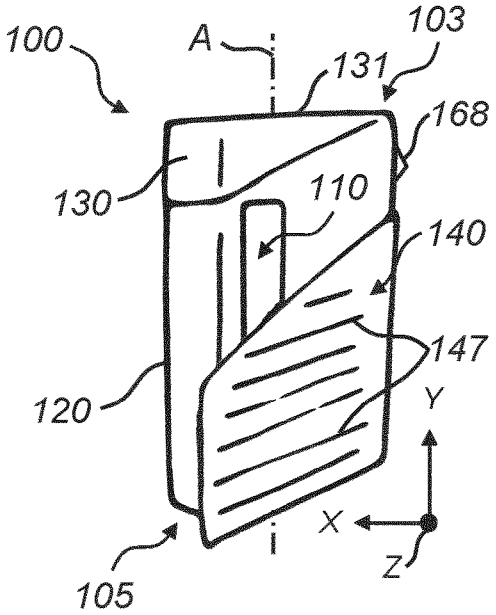
Figure 1C:
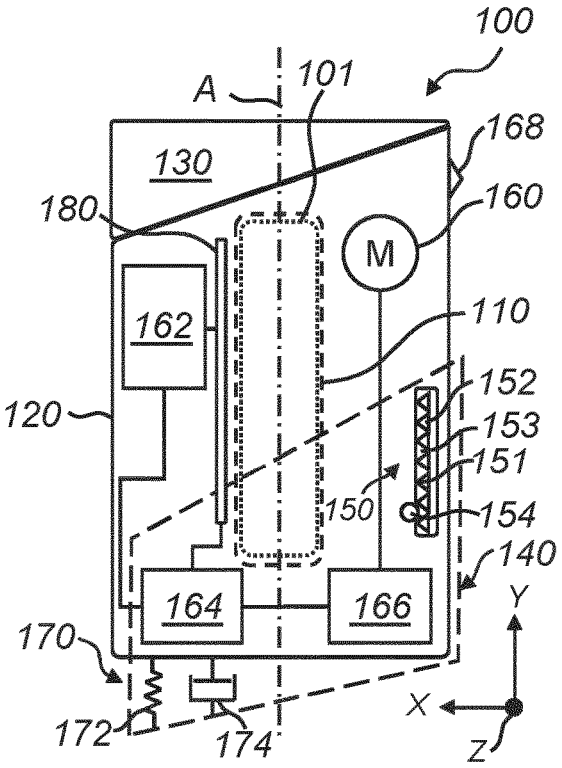
FIG. 1*c* shows a schematic cross-sectional view of the aerosol provision device of FIGS. 1*a* and 1*b*.

Referring to FIGS. 1*a*, 1*b*, and 1*c* an aerosol provision device 100 for generating an inhalable medium is shown.

The aerosol provision device 100 comprises a chamber 110 for receiving a consumable 101 comprising aerosol-generating material. The consumable 101 is shown with a dotted boundary in FIG. 1*c* to schematically indicate where the consumable 101 is positioned when the consumable 101 is in the chamber 110. The aerosol provision device 100 and the consumable 101 form an aerosol provision system. In this embodiment, the chamber 110 is configured so that the consumable 101 abuts walls of the chamber 110 and fits tightly within the chamber 110.

In some embodiments, the chamber 110 comprises an interface (not shown) configured to engage with the consumable 101 to retain the consumable 101 at a predetermined position in the chamber 110. In this embodiment, the consumable 101 is insertable into the chamber 110 via an opening into the chamber 110 provided at a side of the chamber 110. In other embodiments, the consumable 101 may be insertable into the chamber 110 via an opening at an end of the chamber 110.

When the consumable 101 is in the chamber 110, part of the consumable 101 is visible to a user. The part of the consumable 101 is visible when viewing only one side of the aerosol provision device 100 in a depth direction, shown as direction Z. That is, the chamber 110 is configured to cause the consumable 101 to not be visible to a user when viewing a length (longitudinal) direction and a width (transverse) direction, shown as direction Y and direction X, respectively. The consumable 101 is not visible when viewing a length direction Y of the aerosol provision device 100 and a width direction X of the aerosol provision device 100 because the consumable 101 is shielded from view by the aerosol provision device 100. In some embodiments, the chamber 110 may be configured to cause the consumable 101 to protrude from the aerosol provision device 100. Protrusion of the consumable 101 is seen when viewing the aerosol provision device 100 in the longitudinal direction Y and width direction X. In other embodiments, the chamber 110 may be configured to cause the consumable 101 to be concealed, and therefore not visible to the user, when viewing the aerosol provision device 100 in the depth direction Z, when the consumable 101 is in the chamber 110. In other embodiments, the chamber 110 may be configured to cause the consumable 101 to be visible when the aerosol provision device 100 is viewed in a plurality of directions when the consumable 101 is in the chamber 110. In other embodiments, the chamber 110 may be configured to cause the consumable 101 to be entirely concealed when the aerosol provision device 100 is viewed in any direction, and therefore completely invisible to the user, when the consumable 101 is in the chamber 110, unless the aerosol provision device 100, or part of the aerosol provision device 100, is transparent or translucent.

The aerosol provision device 100 comprises an aerosol generator 180 for generating an inhalable medium, such as aerosol, from the aerosol-generating material of the consumable 101 when the consumable 101 is in the chamber 110. In this embodiment the chamber 110 comprises an aerosol generation zone. In this embodiment, the aerosol generator 180 is configured to supply heat to the aerosol-generating material of the consumable 101 to generate the inhalable medium. The aerosol generator 180 therefore comprises an electrical resistance heater. In other embodiments, the aerosol generator 180 may comprise an induction heater or one or more of an electrical resistance heater and an induction heater. In yet other embodiments, pressure could be used to generate an inhalable medium from the consumable. In the embodiment shown in FIGS. 1*a*, 1*b*, and 1*c*, the aerosol generator 180 is positioned to one side of the chamber 110 and extends along a length of the chamber 110. In other embodiments, the aerosol generator 180 may substantially surround the chamber 110. In other embodiments, the aerosol generator 180 may extend only partially along the chamber and/or may be positioned elsewhere relative to the chamber 110. For example, the aerosol generator 180 may be positioned within the chamber 110.

The supply of power to the electrical resistance heater is provided by a power source 162. In this embodiment, the power source 162 is a rechargeable battery. The rechargeable battery is integral to the aerosol provision device 100. In other embodiment, the power source 162 may be replaceable, such as a replaceable battery. In other embodiments, the power source 162 may be a non-rechargeable battery. The power source 162 is configured to provide electrical power to electronic components of the aerosol provision device 100.

The aerosol provision device 100 comprises a body 120, a mouthpiece 130 and a barrier 140. The mouthpiece 130 comprises an opening 131 through which aerosol can be drawn through the mouthpiece 130 by a user of the aerosol provision device 100. The body 120 comprises a portion of the chamber 110. The mouthpiece 130 is arranged at a mouth end 103 of the aerosol provision device 100. The mouth end 103 can be referred to as a buccal end. The barrier 140 is arranged closer to a distal end 105 of the aerosol provision device 100 opposite the mouth end 103, than the barrier is arranged to the mouth end 103.

The barrier 140 comprises seven gripping portions 147 to aid gripping of the barrier 140 by the user. In other embodiments, fewer or more than seven gripping portions 147 may be used. In some embodiments, only one gripping portion 147 may be used. In some embodiments, the gripping portion 147 may be formed on an outer surface of the barrier 140. In other embodiments, the gripping portion 147 may be combined with the outer surface of the barrier 140.

The chamber 110 comprises five walls: a back wall in the depth direction Z; two opposing side walls in the width direction X; and two opposing walls in the longitudinal direction Y. Each of the walls is provided by the body 120. The barrier 140 is configured to provide a block that is movable relative to the walls of the chamber 110. That is, the barrier 140 is configured to inhibit ingress of the consumable 101 into the chamber 110 by blocking access to the chamber 110. The block, formed by the barrier 140, is moveable in the longitudinal direction Y so as to inhibit access to the chamber 110 and vary the visibility of the consumable 101 to the user when inserted in the chamber 110. The longitudinal direction Y is parallel to the longitudinal axis A of the aerosol provision device 100. That is, an opening of the chamber 110 can be partially covered by the barrier 140. In this embodiment, the barrier 140 does not abut the consumable 101 when the consumable 101 is in the chamber 110. In some embodiments, the barrier 140 may be configured to abut the consumable 101. In such embodiments the barrier 140 may be configured to retain the consumable 101 by abutment. The abutment may result in a force being imparted on the consumable 101 to press the consumable 101 and hold the consumable 101 in position.

Although in this embodiment, there are five walls of the chamber 110, in other embodiments, there may be fewer than five walls but at least one. In some embodiments, the body 120 may comprise an arcuate wall of the chamber 110. The arcuate wall may be complementary in shape to a shape of an arcuate consumable 101. In some embodiments, the body 120 may comprise a single wall of the chamber 110 and that single wall may be arcuate.

The mouthpiece 130 is a component through which aerosol, generated from the aerosol-generating material of the consumable 101, can be drawn by the user of the aerosol provision device 100. In this embodiment, the mouthpiece 130 is fixed in position relative to the body 120. In this embodiment, the mouthpiece 130 is arranged centrally of the longitudinal axis A of the aerosol provision device 100. In other embodiments, the mouthpiece 130 may be offset from the longitudinal axis A.

The barrier 140 is discrete from the mouthpiece 130 and movably coupled to the body 120. This allows the barrier 140 to move relative to the body 120 and the mouthpiece 130. The coupling of the barrier 140 and the body 120 ensures that the barrier 140 is retained but still movable. The barrier 140 is movable back-and-forth along the longitudinal axis A. The barrier 140 is therefore a movable component of the aerosol provision device 100. The barrier 140 is also configured to cover part of the opening to the chamber 110 as shown in FIGS. 1*b* and 1*c*. The barrier 140 is therefore configured to open and close the opening of the chamber 110.

The barrier 140 is movable between a first position (as shown in FIGS. 1*b* and 1*c*) and a second position (as shown in FIG. 1*a*). In this embodiment, the barrier 140 is manually operable by the user and is optionally motorized, as discussed below. In the first position, a first portion of the chamber 110 that is visually exposed is smaller than a second portion of the chamber 110 in the second position. The first position is a retracted position because the barrier 140 is retracted to the body 120 and is closer to the mouthpiece 130 than in the second position. The retracted position can be considered a closed position of the barrier 140, wherein the aerosol provision device 100 is in a closed state. The second position is an extended position because the barrier 140 is extended from the body 120 and is further from the mouthpiece 130 than in the first position. The extended position can be considered an open position of the barrier 140, wherein the aerosol provision device 100 is in an open state. In the first position, the barrier 140 inhibits ingress of the consumable 101 into the chamber 110 and egress of the consumable 101 from the chamber 110. In the second position, the barrier 140 allows ingress of the consumable 101 into the chamber 110 and egress of the consumable 101 from the chamber 110. Advantageously, the aerosol provision device 100 is more compact when the aerosol provision device 100 is in the closed state.

When the consumable 101 is in the chamber 110 and the barrier 140 is in the first position, aerosol generated from the aerosol-generating material can be drawn from the consumable 101. A user is therefore able to draw on the mouthpiece 130 to inhale the aerosol generated by the aerosol provision device 100 when the barrier 140 is in the first, closed position. In the first position, the chamber 110 is obstructed by the barrier 140 because the chamber 110 is partially covered by the barrier 140. That is, the barrier 140 is configured such that, in the first position, the chamber 110 at least partially covers an opening into the chamber 110 through which the consumable 101 is insertable. In this embodiment, a user is unable to draw on the mouthpiece 130 when the barrier is in the second position, as is explained with reference to a detector 166 below. The barrier 140 may be of any suitable shape to cover the chamber 110, at least partially, when the barrier 140 is in the first position. In other embodiments, the barrier 140 may entirely cover the chamber 110 when the barrier 140 is in the first position.

When the consumable 101 is removed from the aerosol provision device 100, and the barrier 140 is in the first position to at least partially cover the chamber 110, the chamber 110 is partly open to atmosphere. This helps to protect a user from residual heat in the chamber 110 that is produced by the aerosol generator 180, whilst still allow heat to dissipate from the chamber 110.

As best shown in FIG. 1*c*, the aerosol provision device 100 comprises a guide 150. The guide 150 is configured to guide movement of the barrier 140 in a predetermined manner between the first, closed position and the second, open position of the barrier 140. The guide 150 is optional, such that, in some embodiments, the barrier 140 may move freely between the first and second positions without movement of the barrier 140 being guided. For example, the barrier 140 may be coupled to the body 120 but move freely between the first, closed position and the second, open position of the barrier 140. In such embodiments, the barrier 140 may disengage from the body 120 whilst remaining coupled to the body 120. The barrier 140 may then re-engage to the body 120 in a different location to put the aerosol provision device 100 in an open state. The barrier 140 may therefore move in a random manner between the first and second positions.

In this embodiment, the guide 150 enables the barrier 140 to slide relative to the body 120 between the first, closed position and the second, open position of the barrier 140. That is, the barrier 140 is translationally movable the closed position to the open position. In this embodiment, the translational movement of the barrier 140 is rectilinear. The guide 150 comprises a track 152 and a runner 154. The runner 154 is configured to move along the track 152. The track 152 and the runner 154 provide guided movement beyond what is provided by frictional surface contact between two substantially flat surfaces, as described in relation to other embodiments below. In this embodiment, the barrier 140 comprises the runner 154 and the body 120 comprises the track 152. In other embodiments, the barrier 140 may comprise the track 152 and the body 120 may comprise the runner 154.

As shown in FIG. 1*c*, the track 152 is a series of undulations and the runner 154 is a ball that moves along the undulations. The ball is an example of a detent that is biased towards the runner 154, by a biasing member (not shown but similar to other biasing members described herein), to latch the barrier 140 in a predetermined position relative to the body 120. In other embodiments, the runner 154 may comprise a flexible member that is biased towards the track 152. In such an embodiment, the guide 150 may comprise a snap fit mechanism, wherein the snap-fit mechanism comprises the flexible member and the track 152.

In this embodiment, the track 152 comprises seven protrusions 151 and six grooves 153 therebetween. Each groove 153 is a discrete interval to hold a position of the barrier 140 relative to the body 120. When the runner 154 is a flexible member and the guide is a snap-fit mechanism, the flexible member may be configured to snap in and out of the grooves due to the bias of the flexible member towards the track 152.

In this embodiment, when the barrier 140 is in the first position, as shown in FIGS. 1*b* and 1*c*, the runner 154 is in one extreme end of the six grooves 153, shown as a lower end. In the second position of the barrier 140, as shown in FIG. 1*a*, the runner 154 is in another extreme end of the six grooves 243, shown as an upper end. Each groove 153 between the extreme ends of the grooves 153 corresponds to a different one of a number of predetermined positions of the barrier 140. The number of predetermined positions in this embodiment is four. In other embodiments, the number of predetermined positions may be greater or fewer than four.

A user inserts a consumable 101 through an opening in communication with the chamber 110 and into a chamber 210. Once the consumable 101 is inserted, the user imparts a force on the barrier 140 to move the barrier 140 along the longitudinal axis A of the aerosol provision device 100 from the first position, shown in FIGS. 1*b* and 1*c*, to the second position, shown in FIG. 1*b*. Any resistance provided by the guide 150 would need to be overcome to move the barrier 140 relative to the body 120. In this embodiment, a direction of insertion of the consumable 101 into the chamber 110 is generally perpendicular to a direction of movement of the barrier 140 from the open position to the closed position of the barrier 140.

In this embodiment, the movement of the barrier 140 comprises a discrete number of steps because of the discrete intervals provided by the track 154. In other embodiments, movement of the barrier 140 may be continuous. In this embodiment, it is only when the barrier is in the closed position and held in a discrete position amongst the intervals, that the user can draw aerosol generated from the aerosol-generating material of the consumable 10 through an opening 131 of the mouthpiece 130. In some embodiments, the user may be able to draw when the barrier 140 is in the open position.

In some embodiments, the guide 150 provides for guided movement of the barrier 140 using frictional surface contact between two substantially flat surfaces. In such embodiments, the guide 150 comprises one substantially flat surface and the barrier 140 comprises another substantially flat surface. In such embodiments, an outer surface of the barrier 140 may comprise the another substantially flat surface. In some embodiments, the guide 150 and barrier 140 may comprise non-flat surfaces that still provide the frictional surface contact to allow the guide 150 to guide movement of the barrier 140 in a predetermined manner between the first, closed position and the second, open position of the barrier 140.

The aerosol provision device 100 comprises a damping mechanism 170 configured to control movement of the barrier 140 from the closed position of the barrier 140, as shown in FIGS. 1*b* and 1*c*, to the open position of the barrier 140, as shown in FIG. 1*a*. The damping mechanism 170 comprises a biasing member 172 and a damper 174. In some embodiments, the damping mechanism 170 may comprise only one of the biasing member 172 or damper 174. The biasing member 172 is configured to bias the barrier 140 to the first position and the damper is configured to control a speed at which the barrier 140 moves to dampen movement of the barrier 140 to the first position. The biasing member 172 resists movement of the barrier 140 to the second position in order to reduce the time that the barrier 140 is in the second position. Advantageously, the biasing member 172 and damper 174 provide controlled movement of the barrier 140 along a guide 150.

Although the guide 150 and damping mechanism 170 are shown together in this embodiment. In other embodiments, one of the guide 150 and damping mechanism 170 may be used at once. Further, the guide 150 and/or damping mechanism 170 may be applied to other embodiments discussed herein, even if no guide 150 or damping mechanism 170 is shown in the figures.

The aerosol provision device 100 comprises a detector 166 to detect a position of the barrier 140. In some embodiments the detector 166 may detect insertion of the consumable 101 into the chamber 110. In some embodiments two detectors may be provided, wherein one detector detects a position of the barrier 140 and another detector detects insertion of the consumable 101 into the chamber 110. The aerosol provision device 100 also comprises a controller 164 and a driving mechanism in the form of a motor 160. The controller 164 is configured to receive an output from the detector 166 and cause the motor 160 to drive movement of the barrier 140 relative to the body 120 from the first, closed position to the second, open position of the barrier 140. In some embodiments, the controller 164 may be configured to activate the aerosol generator 180 once the detector 166 has detected the presence of the consumable 101 in the chamber 110 and/or when the detector 166 has detected a position of the barrier 140, such as a closed and/or open position. In some embodiments, activation of the aerosol generator 180 by the controller 164 is immediate. In other embodiments, activation of the aerosol generator 180 by the controller 164 is delayed by a predetermined time. The movement of the barrier 140 can therefore be on the basis of the output from the detector 166. The detector 166, the controller 164, the motor 160, and the aerosol generator 180 are each powered by the power source 162.

In some embodiments, withdrawal of the consumable 101 from the chamber 110, which leads to an absence of the consumable 101 from the aerosol provision device 100, is additionally or alternatively detectable by the detector 166. Therefore, removing the consumable 101 from the chamber 110 is also configured to move the barrier 140 in reverse. That is, the controller 164 may be configured to receive an output from the detector 166 to detect an absence of the consumable 101 in chamber 110 and cause the motor 160 to drive movement of the barrier 140 relative to the body 120 from the second, open position to the first, closed position of the barrier 140.

In this embodiment, a user can operate a switch 168 to turn the detector 166 on or off. The switch 168 is manually operable and is configured to send an electronic signal to the controller 160 to allow the detector 166 to be enabled or disabled. In this embodiment, the switch 168 is a push switch. In other embodiments, the switch 168 is a sliding switch. In some embodiments, the switch 168 does not require movement to be imparted by the user on the switch 168 to operate the switch 168. For example, the switch 168 may comprise capacitive sensing to sense a presence of the user. When the detector 166 is turned off by the switch 168, the barrier 140 moves by manual operation of the barrier 140. When the detector 166 is turned on, the barrier 140 moves by operation of the motor 160.

Figure 2:
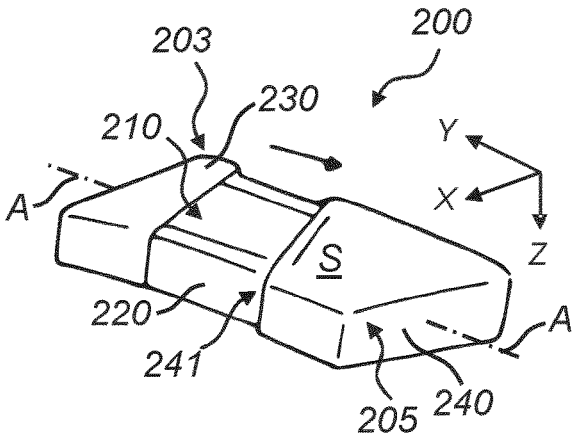
FIG. 2 shows a perspective view of an aerosol provision device.

FIG. 2 shows an aerosol provision device 200. Similar components in the aerosol provision device 200 have the same reference numbers as those of FIGS. 1*a*, 1*b*, and 1*c* but the reference numbers are increased by 100. Such common features are not discussed again. The discussion of the aerosol provision system 200 below is limited to the differences. The aerosol provision device 200 may comprise features discussed previously that are compatible with the aerosol provision device 200 but are not shown in FIG. 2. Non-exhaustive examples include a damping mechanism, a detector, a controller, a motor, an aerosol generator, a power source, and a switch.

The aerosol provision device 200 comprises a barrier 240 that wraps around a body 220. That is, the barrier 240 comprises an opening 241 that is to receive the body 220 within an internal space S of the barrier 240. The barrier 240 is configured to slide relative to the body 220 along a longitudinal axis A of the aerosol provision device 200. The aerosol provision device 200 also comprises a chamber 210 for receiving a consumable. When the barrier 240 is arranged in an open position, as shown in FIG. 2, the chamber 210 is exposed and visible to a user. This is because a mouth end 203 of the aerosol provision device 200 is arranged at a furthest point from a distal end 205 of the aerosol provision device 200. However, when the barrier 240 is arranged in a closed position, the chamber 210 is fully concealed and is no longer visible to the user. This is because the mouth end 203 of the aerosol provision device 200 is arranged at a closest point to the distal end 205 of the aerosol provision device 200. Advantageously, the chamber 210 can be entirely blocked by the barrier 240 when the barrier 240 is in the closed position. This is beneficial when the aerosol provision device 200 is stored by the user or when the user is drawing on a consumable within the chamber 210 of the aerosol provision device 200. Advantageously, the barrier 240 enables the aerosol provision device 200 to be compact when in the closed position of the barrier 240 compared to the open position of the barrier 240. In the closed position of the barrier 240, the barrier 240 is configured to abut the mouthpiece 230, which is arranged at the mouth end 203 of the aerosol provision device 200.

FIGS. 3, 4, 5, 6*a*, and 6*b* show aerosol provision systems 300S, 400S, 5005, 600S. The aerosol provision systems 300S, 400S, 5005, 600S comprise aerosol provision devices 300, 400, 500, 600 and respective consumables 301, 401, 501, 601. Similar components in the aerosol provision devices 300, 400, 500, 600 have the same reference numbers as those of FIGS. 1*a*, 1*b*, and 1*c* but the reference numbers are increased by 200, 300, 400, 500, respectively. Similar components in the aerosol provision devices 300, 400, 500, 600 have the same reference numbers as those of FIG. 2 but the reference numbers are increased by 100, 200, 300, 400, respectively. Such common features are not discussed again. The discussion of the aerosol provision systems 300S, 400S, 5005, 600S below is limited to the differences. The aerosol provision devices 300, 400, 500, 600 may comprise features discussed previously that are compatible with the aerosol provision device 300, 400, 500, 600 but are not shown in the figures. Non-exhaustive examples include a damping mechanism, a detector, a controller, a motor, an aerosol generator, a power source, and a switch.

Figure 3:
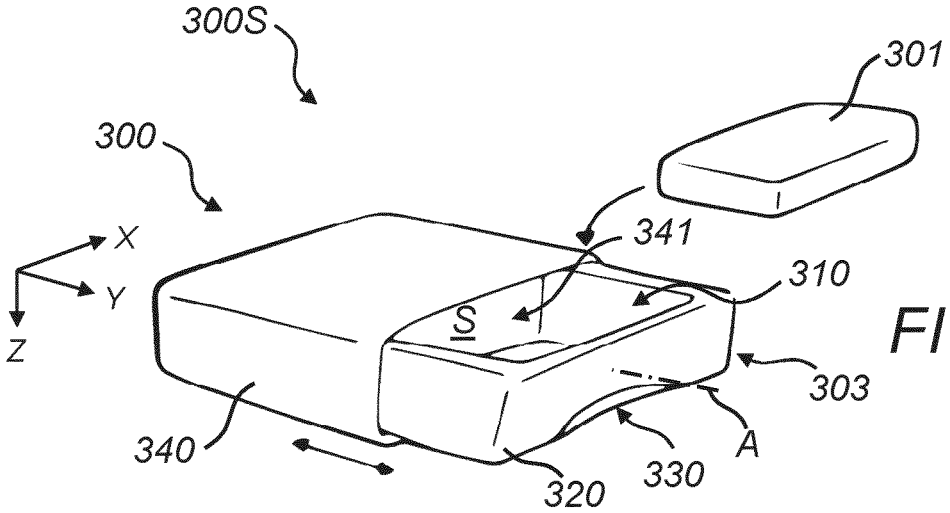
FIGS. 3 to 5 show perspective views of aerosol provision systems.
Figure 4:
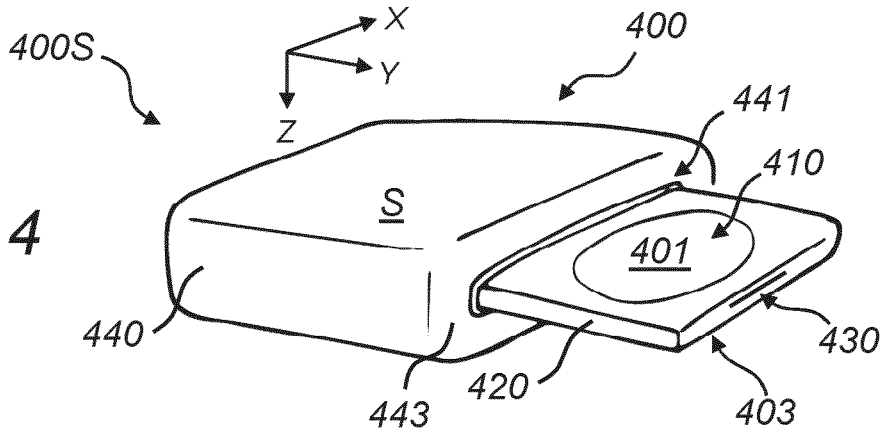
Figure 5:
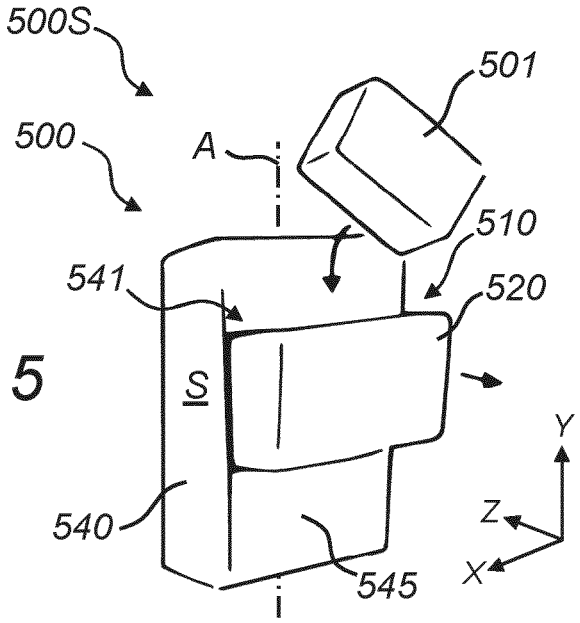

The aerosol provision devices 300, 400, 500 shown in FIGS. 3, 4, and 5, each respectively comprise a barrier 340, 440, 540 that is configured to slide relative to the respective bodies 320, 420, 520. As discussed with the aerosol provision device 200 of FIG. 2, the barriers 340, 440, 540 of these aerosol provision devices 300, 400, 500 are configured to wrap around the respective bodies 320, 420, 520 when the aerosol provision devices 300, 400, 500 are each arranged in a closed state. In the open state of the aerosol provision devices 300, 400, 500, the respective barriers 340, 440, 540 and bodies 320, 420, 520 are spaced apart from each other so as to allow a respective consumable 301, 401, 501 to be inserted through a respective opening 341, 441, 541 and into the respective chamber 310, 410, 510. In each of the aerosol provision devices 300, 400, 500, the respective bodies 320, 420, 520 are configured to pass through the respective openings 341, 441, 541 during movement of the aerosol provision devices 300, 400, 500 between the closed state and the open state.

Each barrier 340, 440 in the aerosol provision devices 300, 400 comprises an internal space S that is configured to fully receive the respective bodies 320, 420. The barriers 340, 440 are configured to move in the longitudinal direction Y and along the longitudinal axis A of the respective aerosol provision devices 300, 400. In each of the aerosol provision devices 300, 400, a mouthpiece 330, 430 is arranged at a mouth end 303, 403 of the respective body 320, 420. In aerosol provision device 300, the mouthpiece 330 is offset from the longitudinal axis A and provided to one side of the body 320 in a depth direction Z. In contrast, in aerosol provision device 500, the barrier 540 is configured to move relative to the body 520 in the depth direction Z. That is, the body 520 is configured to move away from a side 545 of the barrier 540 in a direction perpendicular to a direction of the longitudinal axis A.

In aerosol provision device 300, the barrier 340 comprises a thickness, as measured in the depth direction Z, that is only marginally greater than a thickness of the body 320. In contrast, in aerosol provision device 400, the barrier 440 comprises a thickness that is greater than double a thickness of the body 320. That is, an end 443 of the barrier 440 comprises a surface area that is greater than a surface area of a corresponding end of the body 420.

Each body 320, 420, 520 of the aerosol provision devices 300, 400, 500 is a drawer that retracts into and extends from a respective internal space S of the respective barrier 340, 440, 540. Each chamber 310, 410, 510 is a space within the drawer. In some embodiments, the drawers move by action of a set of rollers. For example, in some embodiments, the aerosol provision devices 300, 400, 500 comprise a guide comprising a track and a roller than rolls along the track. In some embodiments, the track is located on the body 320, 420, 520 and the roller is located on the barrier 340, 440, 540. In other embodiments, the track is located on the barrier 340, 440, 540 and the roller is located on the body 320, 420, 520.

The aerosol provision device 600 comprises a barrier 640 that is configured to rotate relative to a body 620. Relative rotation of the barrier 640 and body 620 is guided by a guide 650. The guide 650 comprises a pivot 655 that comprises an axis of rotation about which the barrier 640 is rotatably coupled to the body 620. The pivot 655 therefore guides rotational movement of the barrier 640 relative to the body 620. In this embodiment, the axis of rotation is in the transverse (width) direction X of the aerosol provision device 600 that is perpendicular to a longitudinal axis A of the aerosol provision device 600. In other embodiments, the axis of rotation of the pivot 655 may be provided in an oblique direction to the longitudinal axis A of the aerosol provision device 600. In other embodiments, the pivot 655 may rotate about a length direction Y or a depth direction Z such that the axis of the pivot 655 is provided in the length direction Y or the depth direction Z, respectively.

Figure 6A:
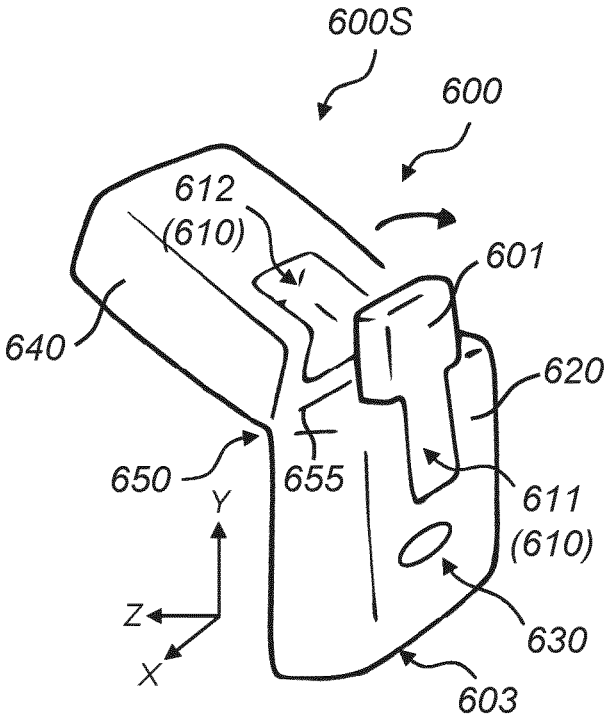
FIGS. 6*a* and 6*b* each show a perspective view of an aerosol provision system.
Figure 6B:
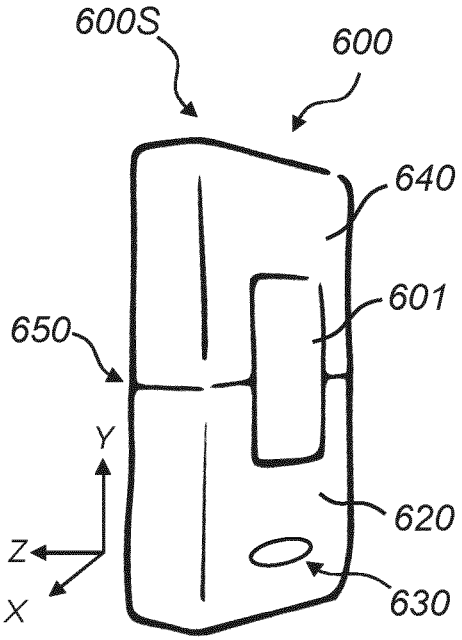

The barrier 640 is arranged between the first position, as shown in FIG. 6*b*, and the second position, as shown in FIG. 6*a*, by rotation of the barrier 640 about the pivot 655. In this embodiment, the rotational movement is manually operable, although in some embodiments, this may be electro-mechanically controlled. In some embodiments, the barrier 640 may latch into one or both of the first and second positions. In some embodiments, the guide 650 may be a hinge comprising the pivot 655. The hinge may be of any suitable form, such as a living hinge. In some embodiments, the pivot 655 may comprise a rod, pin or an axle.

In this embodiment, the chamber 610 comprises a first chamber 611 and a second chamber 612. The body comprises the first chamber 611 and the barrier 640 comprises the second chamber 612. Each of the barrier 640 and the body 620 is therefore configured to receive a portion of the consumable 610. When the barrier 640 is arranged in the first position, as shown in FIG. 6*b*, an end of the consumable 601 is enclosed by the barrier 640. When the barrier 640 is arranged in the second position, as shown in FIG. 6*a*, the end of the consumable 601 is exposed by the barrier 640. When a consumable 601 is inserted into one of the first chamber 611 and the second chamber 612, the consumable 601 is prevented from removal from the aerosol provision device 600 by obstruction from the part of the aerosol provision device 600 comprising the other one of the first chamber 611 or the second chamber 612. For example, in FIG. 6*a*, the consumable 601 is inserted in the first chamber 611 so that when the consumable 601 is received by the second chamber 612, the barrier 640 inhibits removal of the consumable 601 from the chamber 610.

In this embodiment, the aerosol provision device 600 comprises a mouthpiece 630 that is arranged at a mouth end 603 of the aerosol provision device 600. The mouthpiece 630 faces a depth direction Z.

Figure 7:
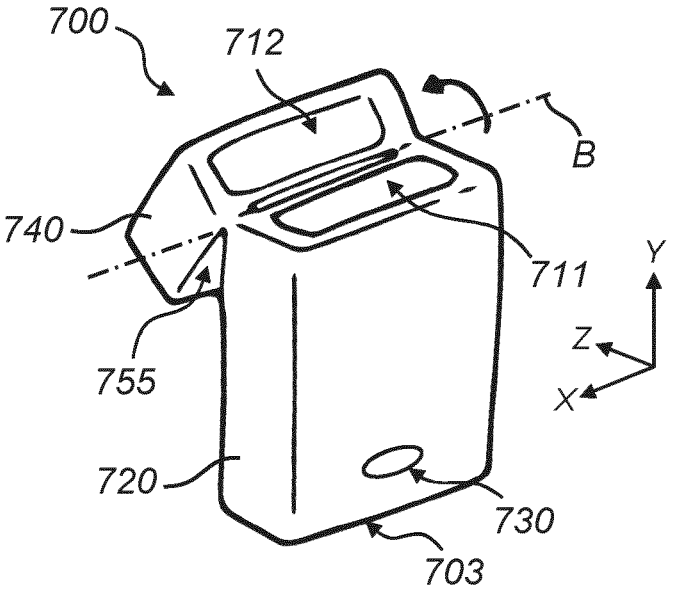
FIG. 7 shows a perspective view of an aerosol provision device.

FIG. 7 shows an aerosol provision device 700. The aerosol provision device 700 is similarly arranged to aerosol provision device 600 of FIGS. 6*a* and 6*b*. That is, aerosol provision device 700 comprises a barrier 740 that is relatively rotatable about a body 720, wherein rotation is provided by a pivot 755 with an axis of rotation B. A mouthpiece 730 is also arranged at a mouth end 703. In contrast to aerosol provision device 600 of FIGS. 6*a* and 6*b*, aerosol provision device 700 comprises a first chamber 711 and second chamber 712 that are configured to completely envelope the consumable. The first chamber 711 is configured to envelope one portion of the consumable and the second chamber 712 is configured to envelope another portion of the consumable. As with aerosol provision device 600, the consumable is inserted into one of the first and second chambers 711, 712 when the aerosol provision device 700 is arranged in the open state, wherein the other one of the first and second chambers 711, 712 encloses the consumable when the aerosol provision device 700 is arranged in the closed state. Advantageously, the consumable is concealed from the user when the aerosol provision device 700 is arranged in the closed state.

FIG. 8 to FIG. 21*b* show aerosol provision devices and/or aerosol provision systems comprising an aerosol provision device and a consumable. Similar components have the same reference numbers from previous embodiments but the reference numbers are incremented by a multiple of 100. Common features are not discussed again. The discussion of the embodiments shown in FIG. 8 to FIG. 21*b* are limited to the differences over other embodiments described herein. The aerosol provision devices shown in FIG. 8 to FIG. 21*b* may comprise features discussed previously that are compatible with these aerosol provision devices but are not shown in the figures. Non-exhaustive examples include a damping mechanism, a detector, a controller, a motor, an aerosol generator, a power source, and a switch.

Figure 8:
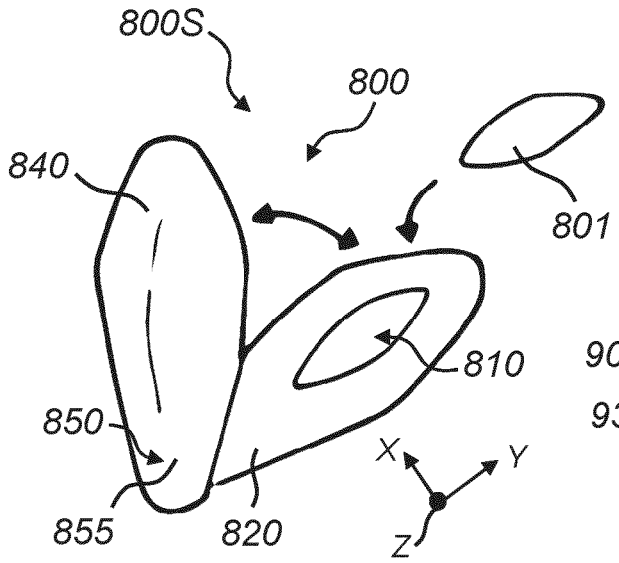
FIG. 8 shows a perspective view of an aerosol provision system.

Referring to FIG. 8, an aerosol provision system 800S is shown. The aerosol provision system 800S comprises an aerosol provision device 800 and a consumable 801. The aerosol provision device 800 is shown in the open state such that a barrier 840 is rotated away from a body 820 to reveal a chamber 810 into which a consumable 801 can be deposited. Relative rotation of the barrier 840 and body 820 is guided by a guide 850 as discussed in relation to aerosol provision device 600, for example. That is, the guide 850 comprises a pivot 855. The pivot 855 comprises an axis of rotation about which the barrier 840 is rotatably coupled to the body 820. However, in aerosol provision device 800, the axis of rotation is in the depth direction Z. In this embodiment, the chamber 810 is a single chamber and the barrier 840 merely acts to inhibit ingress and egress of the consumable 801 into and out of the chamber 810. In this embodiment, the consumable 801 comprises a shape in the form of a lozenge, wherein the consumable 801 comprises a shape of a rhombus when viewing the consumable 801 in the depth direction Z. The shape and form of the consumable 801 is not limited to that shown in FIG. 8.

Figure 9:
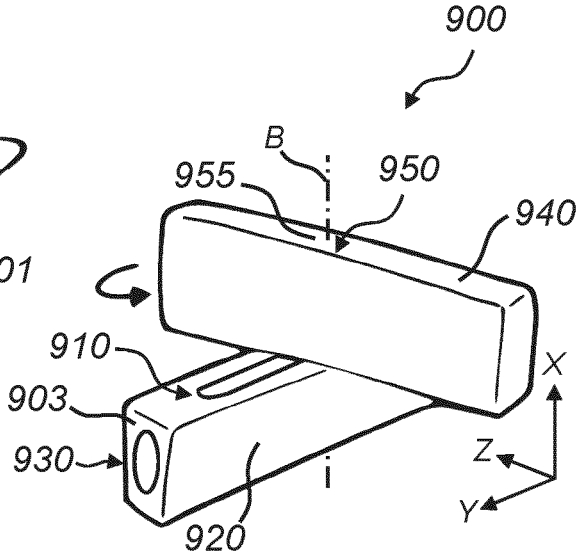
FIGS. 9 to 11 show perspective views of aerosol provision devices.

Referring to FIG. 9, an aerosol provision device 900 is shown. The aerosol provision device 900 is shown in the open state such that a barrier 940 is rotated away from a body 920 to reveal a chamber 910 into which a consumable (not shown) can be deposited. As with aerosol provision device 800, relative rotation of the barrier 940 and body 920 is guided by a guide 950 comprising a pivot 955 having an axis of rotation B about which the barrier 940 is rotatably coupled to the body 920. However, in aerosol provision device 900, the axis of rotation is in the width direction X. The aerosol provision device 900 comprises a buccal end 903 comprising a mouthpiece 930. The axis of rotation B of the barrier 940 is located away from the buccal end 903 of the aerosol provision device 900. The axis of rotation B is also perpendicular to a longitudinal direction Y of the aerosol provision device 900. The barrier 940 and body 920 of aerosol provision device 900 are two parts that are substantially elongate and relatively rotatable. That is, the aerosol provision device 900 is split longitudinally into the two parts 920, 940.

Figure 10:
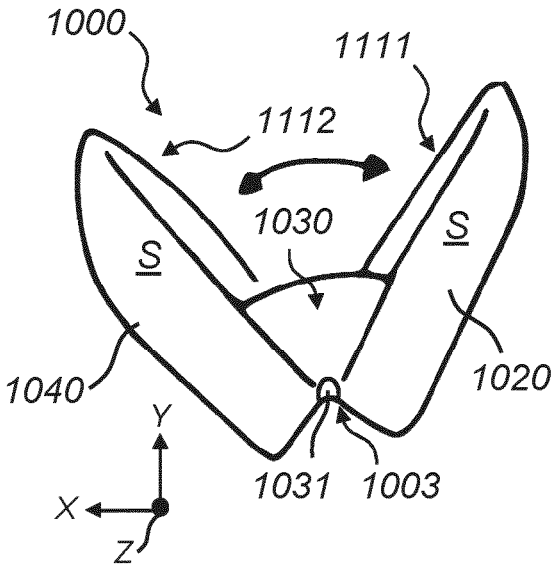

Referring to FIG. 10, an aerosol provision device 1000 is shown. The aerosol provision device 1000 is in the form of a clamshell. That is, the aerosol provision device 1000 comprises a barrier 1040 and a body 1020 that form two halves and are rotatably coupled to each other. A hinge (not shown) is provided to allow the aerosol provision device 1000 to close in the close state and open in the open state, as shown in FIG. 10. In the open state, the entirety of a mouthpiece 1030 is revealed. The mouthpiece 1030 comprises an opening 1031, arranged at a mouth end 1003, through which aerosol can be drawn through the mouthpiece 1030 by a user of the aerosol provision device 1000. As discussed with aerosol provision device 700 shown in FIG. 7, the aerosol provision device 1000 comprises a first chamber 1011 and second chamber 1012 that are configured to completely envelope a consumable that insertable into a spaces S within each of the barrier 1040 and body 1020. The first chamber 1011 is configured to envelope one portion of the consumable and the second chamber 1012 is configured to envelope another portion of the consumable. Advantageously, the consumable is fully concealed from the user when the aerosol provision device 1000 is arranged in the closed state.

Figure 11:
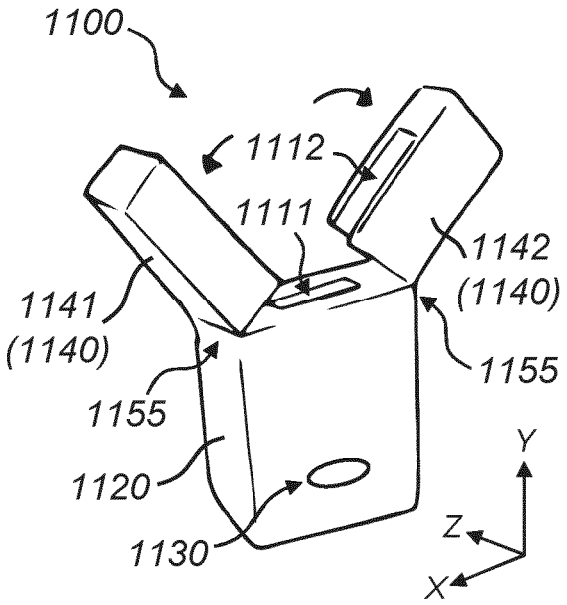

Referring to FIG. 11, an aerosol provision device 1100 is shown. The aerosol provision device 1100 is similar to aerosol provision device 1000 in that the aerosol provision device 1100 comprises a body 1120 having a first chamber 1111 for receiving a first portion of a consumable and barrier 1140 having a second chamber 1112 for receiving a second portion of the consumable. Here, the barrier 1140 comprises a first part 1141 and a second part 1142. In this embodiment, only the second part 1142 of the barrier 1140 comprises the second chamber 1112. In other embodiments, the first part 1141 of the barrier 1140 may also comprise a chamber for receiving a third portion of the consumable. The first part 1141 and the second part 1142 of the barrier 1140 are pivotably coupled to the body 1120 by respective pivots 1155. Each of the respective pivots 1155 comprises an axis of rotation in the same direction, shown in FIG. 11 as the depth direction Z. In other embodiments, each of the respective pivots 1155 may comprise an axis of rotation in a different direction of the aerosol provision device 1100. FIG. 11 further shows a mouthpiece 1130 of the aerosol provision device 1100 that is fixed in position relative to the body 1120 and discrete from the barrier 1140.

Figure 12:
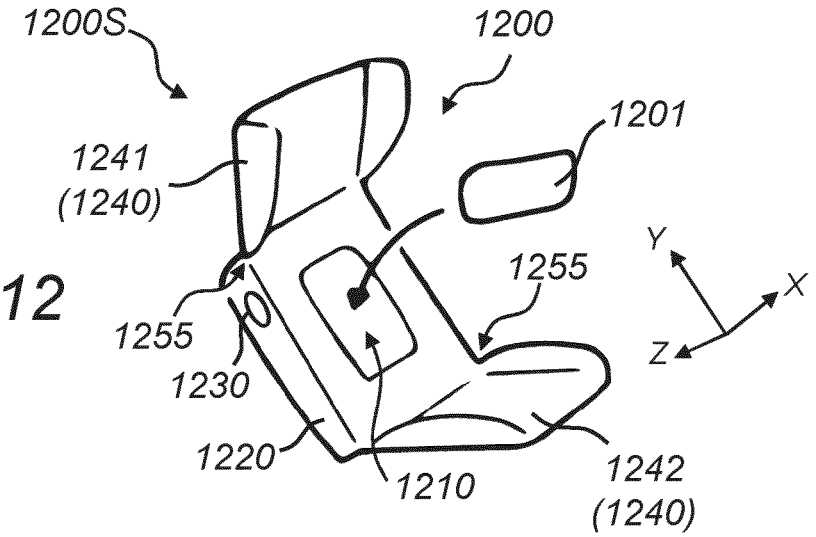
FIG. 12 shows a perspective view of an aerosol provision system.
Figure 13:
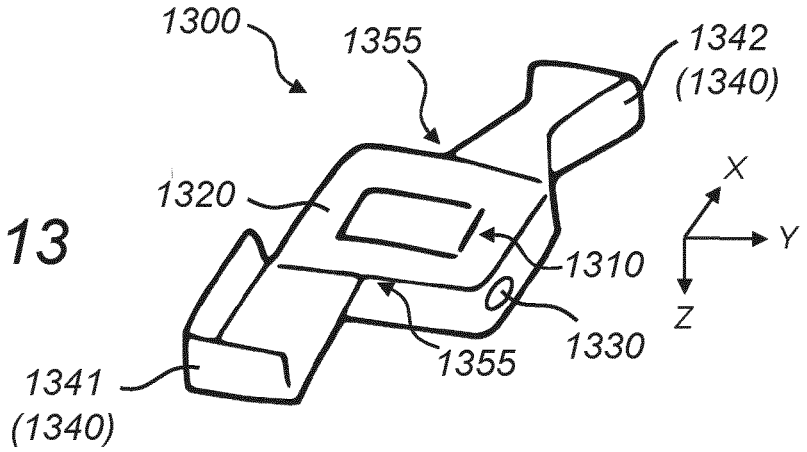
FIG. 13 shows a perspective view of an aerosol provision device.
Figure 14:
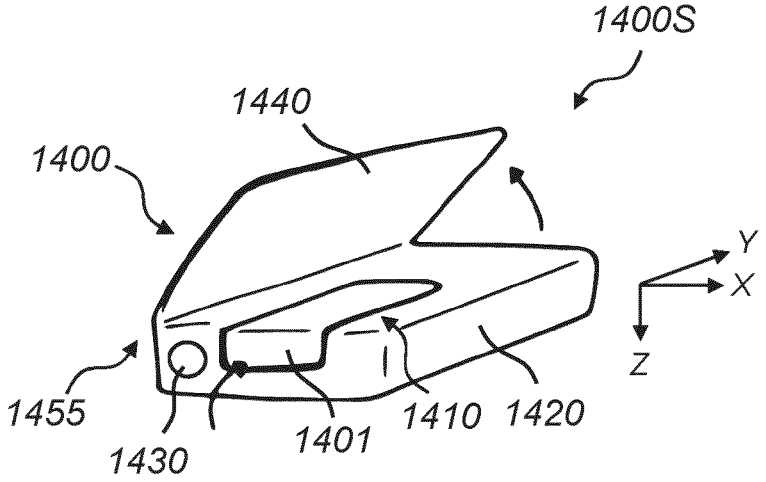
FIGS. 14 to 16 show perspective views of aerosol provision systems.
Figure 15:
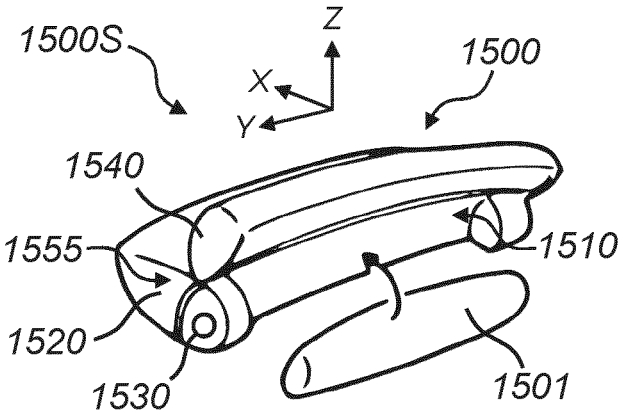
Figure 16:
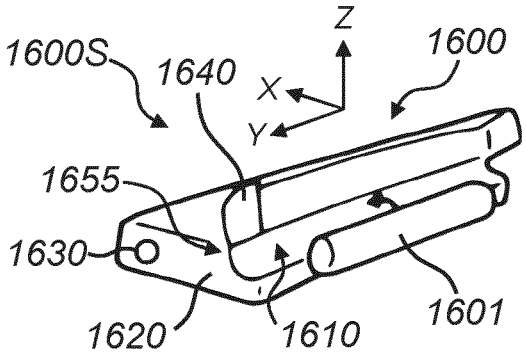

Referring to FIGS. 12, 13, and 14, aerosol provision devices 1200, 1300, 1400 are shown. Some of the aerosol provision devices 1200, 1400 are shown as part of an aerosol provision system 1200S, 1400S. Each aerosol provision device 1200, 1300, 1400 comprises a barrier 1240, 1340, 1440 that is planar or comprises at least one planar portion. For example, the barrier 1440 of aerosol provision device 1400 is planar, whereas the barriers 1240, 1340 of aerosol provision devices 1200, 1300 comprise many planar portions. Each of the barriers 1240, 1340, 1440 is pivotably coupled to a respective body 1220, 1320, 1420 by a respective pivot 1255, 1355, 1455. Each pivot 1255, 1355, 1455 comprises an axis of rotation in the length direction Y of the respective provision device 1200, 1300, 1400.

A difference between aerosol provision devices 1200, 1300 and aerosol provision device 1400, is that aerosol provision device 1400 comprises a single barrier 1440, whereas aerosol provision devices 1200, 1300 comprise a first barrier 1241, 1341 and a second barrier 1242, 1342. The first barrier 1241, 1341 and the second barrier 1242, 1342 are movable relative to each other with respect to the bodies 1220, 1320. Nevertheless, each of the barriers 1240, 1340, 1440 inhibits ingress of a consumable 1201, 1401 into a chamber 1210, 1310, 1410 and egress of the consumable 1201, 1401 from the chamber 1210, 1310, 1410 when each aerosol provision device 1200, 1300, 1400 is arranged in a closed state (not shown). Further, when the aerosol provision devices 1200, 1300, 1400 are each arranged in an open state, shown in FIGS. 12, 13, and 14, the respective barriers 1240, 1340, 1440 allow ingress of the consumable 1201, 1401 into the respective chambers 1210, 1310, 1410 and egress of the consumable 1201, 1401 from the respective chambers 1210, 1310, 1410.

The axes of rotation of the first barrier 1241, 1341 and the second barrier 1242, 1342 in aerosol provision devices 1200, 1300 are opposed. The first barrier 1241 and the axis of rotation of the first barrier 1241 in aerosol provision device 1200 are each opposed to the second barrier 1242 and the axis of rotation of the second barrier 1242 in the length direction Y, respectively. The first barrier 1341 and the axis of rotation of the first barrier 1341 in aerosol provision device 1300 are each opposed to the second barrier 1342 and the axis of rotation of the second barrier 1342 in the length direction width direction X, respectively. Further, each of the first barrier 1341 and the second barrier 1342, in aerosol provision device 1300, are arranged close to opposing corners of the aerosol provision device 1300. All first barriers 1241, 1341 and second barriers 1242, 1342 in aerosol provision devices 1200, 1300 comprise tabs to cover a side of the respective bodies 1220, 1320 as well as tops to cover and block a portion of the respective chambers 1210, 1310. FIGS. 12, 13 and 14 further show a mouthpiece 1230, 1330, 1430 of the respective aerosol provision devices 1200, 1300, 1400 that are each fixed in position relative to the respective bodies 1220, 1320, 1420 and are each discrete from the respective barriers 1240, 1340, 1440.

Referring to FIGS. 15 to 18*b*, aerosol provision devices 1500, 1600, 1700, 1800 are shown. Some of the aerosol provision devices 1500, 1600 are shown as part of an aerosol provision system 15005, 1600S. The aerosol provision systems 15005, 1600S each comprise a consumable 1501, 1601. Each aerosol provision device 1500, 1600, 1700, 1800 comprises a barrier 1540, 1640, 1740, 1840 that is pivotably coupled to a respective body 1520, 1620, 1720, 1820. Each barrier 1540, 1640, 1740, 1840 is configured to rotate with respect to the respective body 1520, 1620, 1720, 1820 about a respective pivot 1555, 1655, 1755, 1855. Each pivot 1555, 1655, 1755, 1855 comprises an axis of rotation B in the longitudinal direction Y of the respective aerosol provision device 1500, 1600, 1700, 1800. The axis of rotation B in aerosol provision devices 1500, 1600, 1700 are offset from a longitudinal axis A of the respective aerosol provision device 1500, 1600, 1700. In contrast, the axis of rotation B in aerosol provision device 1800 is coaxial with the longitudinal axis A of the aerosol provision device 1800. In aerosol provision devices 1500, 1600, the axes of rotation are offset in a width and depth direction from the longitudinal axes. In aerosol provision devices 1700, the axis of rotation B is offset only in a width direction X and not in a depth direction Z from the longitudinal axis A of the aerosol provision device 1700.

Figure 17A:
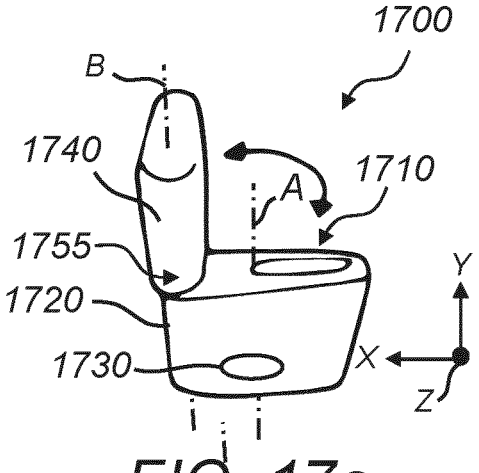
FIGS. 17*a* and 17*b* each show a perspective view of an aerosol provision device.
Figure 17B:
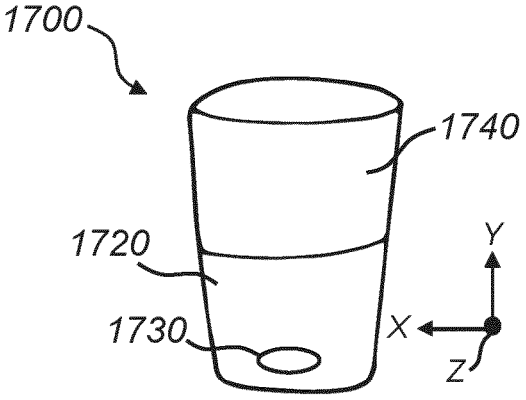
Figure 18A:
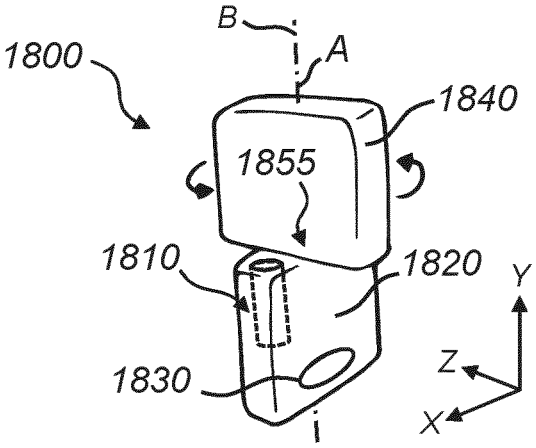
FIGS. 18*a* and 18*b* each show a perspective view of an aerosol provision device.
Figure 18B:
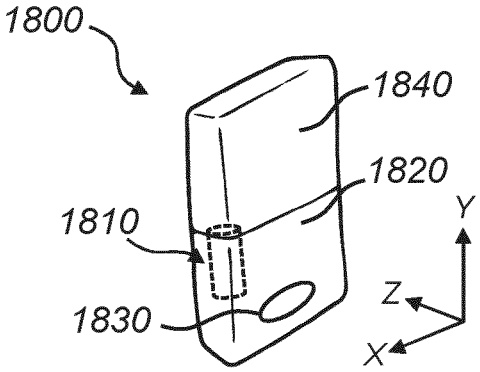

Each of the barriers 1540, 1640, 1740, 1840 inhibits ingress of a consumable 1501, 1601 into a respective chamber 1510, 1610, 1710, 1810 and egress of the consumable 1501, 1601 from the chamber 1510, 1610, 1710, 1810 when each aerosol provision device 1500, 1600, 1700, 1800 is arranged in a closed state (see FIGS. 17*b* and 18*b*, for example). Further, when the aerosol provision devices 1500, 1600, 1700, 1800 are each arranged in an open state, shown in FIGS. 15, 16, 17*a*, 18*b*, the respective barriers 1540, 1640, 1740, 1840 allow ingress of the consumable 1501, 1601 into the respective chambers 1510, 1610, 1710, 1810 and egress of the consumable 1501, 1601 from the respective chambers 1510, 1610, 1710, 1810. FIG. 15 to FIG. 18*b* further show a mouthpiece 1530, 1630, 1730, 1830 of the respective aerosol provision device 1500, 1600, 1700, 1800 that is fixed in position relative to the respective bodies 1520, 1620, 1720, 1820 and are each discrete from the respective barriers 1540, 1640, 1740, 1840.

Figure 19A:
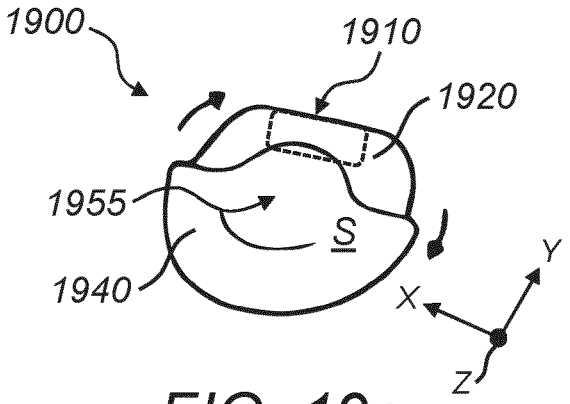
FIGS. 19*a* and 19*b* each show a perspective view of an aerosol provision device.
Figure 19B:
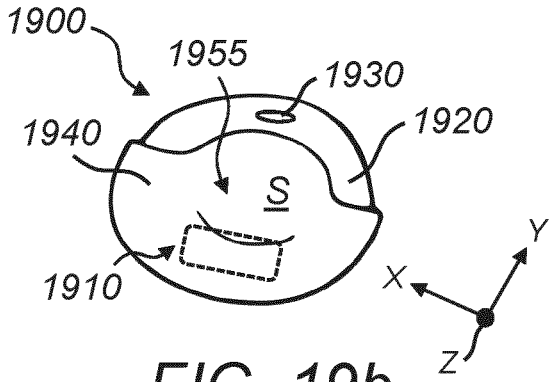

Referring to FIGS. 19*a* and 19*b*, an aerosol provision device 1900 is shown. The aerosol provision device 1900 comprises a barrier 1940 that is rotatably coupled to a body 1920. The barrier 1940 rotates around the body 1920. In this embodiment, an axis of rotation of a pivot 1955 of the barrier 1940 is located at a center of the aerosol provision device 1900 in a width direction X and a length direction Y. The aerosol provision device 1900 is substantially circular. A user can therefore twist one of the barrier 1940 or the body 1920 to cause relative rotation between the barrier 1940 and the body 1920 and expose or conceal a chamber 1910 and a mouthpiece 1930 in an open state (shown in FIG. 19*a*) or closed state (shown in FIG. 19*b*) of the aerosol provision device 1900. In this embodiment, only one of the chamber 1910 and the mouthpiece 1930 is exposed or concealed at the same time. When concealed the chamber 1910 or the mouthpiece 1930 are concealed by the barrier 1940 in an internal space S of the barrier 1940.

In some embodiments, the aerosol provision device 1900 can lock in the open state and/or the closed state by a retention member. When the aerosol provision device 1900 is arranged in the closed state (shown in FIG. 19*b*), an aerosol generator of the aerosol provision device 1900 may be activated to cause production of aerosol from a consumable inserted in the chamber 1910. Other aerosol provision devices mentioned herein may also perform such functionality.

Figure 20:
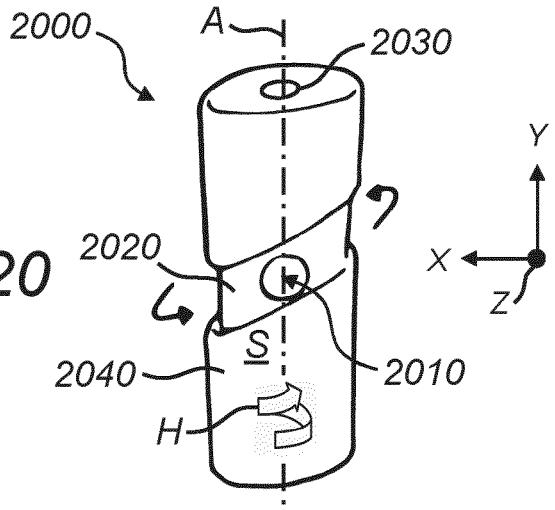
FIG. 20 shows a perspective view of an aerosol provision device.

Referring to FIG. 20, an aerosol provision device 2000 is shown. The aerosol provision device 2000 comprises a barrier 2040 that is helically rotatable about a longitudinal axis A of the aerosol provision device 2000. That is, the barrier 2040 moves helically along a guide (not shown) so that the barrier 2040 retracts and extends from a body 2020 in the longitudinal direction Y. Put another way, the barrier 2040 is configured to move along a helical path, as shown by a helical arrow H in FIG. 20, when the barrier 2040 moves between an open position, shown in FIG. 20, and a closed position (not shown).

A user can twist the barrier 2040 relative to the body 2020 to cause relative rotation between the barrier 2040 and the body 2020 and expose or conceal the chamber 2010. A mouthpiece 2030 remains exposed in both the closed state and the open state. When the barrier 2040 moves to the closed position a space S in a cavity of the barrier 2040 receives a portion of the body 2020. In the closed position, a chamber for receiving a consumable is blocked by the barrier 2040. In the open position, the chamber is unblocked by the barrier 2040.

In this embodiment, the body 2020 comprises one part of the guide and the barrier 2040 comprises another part of the guide. In this embodiment, the guide comprises threaded portions (not shown) that engage with each other to determine the helical path. That is, the body 2020 and barrier 2040 each comprise a threaded portion that movably engage to provide helical motion of the barrier 2040 relative to the body 2020. In this embodiment, the mouthpiece 2030 is fixed relative to the body 2020 so that the barrier also moves relative to the mouthpiece 2030. However, in other embodiments, the mouthpiece 2030 may also move relative to the body 2020 and barrier 2040 along a guide. In such an embodiment, the body 2020 would comprise a first threaded portion for engagement with the barrier 2040 and a second threaded portion for engagement with the mouthpiece 2030. In this embodiment, movement of the barrier 2040 along the helical path is continuous. However, in other embodiments, the movement of the barrier 2040 along the helical path may be in discrete intervals.

Figure 21A:
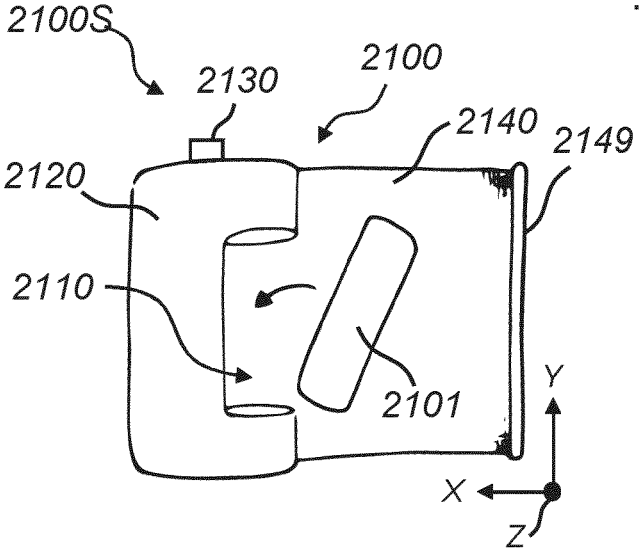
FIGS. 21*a* and 21*b* each show a perspective view of an aerosol provision system.
Figure 21B:
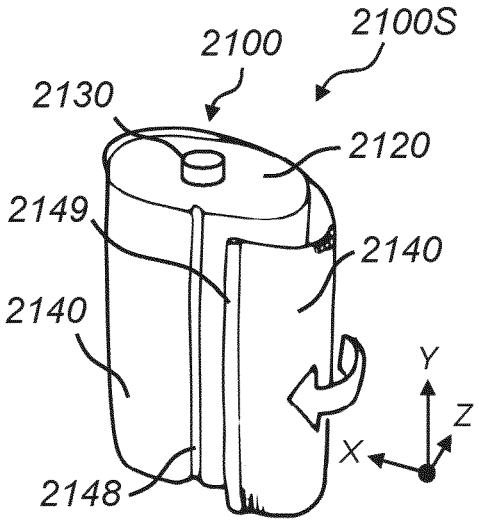

Referring to FIGS. 21*a* and 21*b*, an aerosol provision system 2100S is shown. The aerosol provision system 2100S comprises an aerosol provision device 2100 and a consumable 2101. The aerosol provision device 2100 comprises a barrier 2140 that is a flexible member. The barrier 2140 is therefore flexibly movable about a body 2120. In this embodiment, the barrier 2140 comprises an elastic memory so that the barrier 2140 returns to a rest position. The barrier 2140 is configured to roll about the body 2120. This allows the barrier 2140 to bias towards a closed state. That is, force is required to open the barrier 2140 to an open state (shown in FIG. 21*a*). In some embodiments, the barrier 2140 is free to move without any resistance from the barrier 2140. The barrier 2140 comprises a first engagement portion 2148 and a second engagement portion 2149 that engage in the closed state of the aerosol provision device 2100. The first engagement portion 2148 and the second engagement portion 2149 engage by magnetism. In other embodiments, the first engagement portion 2148 and the second engagement portion 2149 may engage in other ways, such as by snap fitting together, or buttoning together, or clipping together, for example.

In FIG. 21*a*, the aerosol provision device 2100 is shown in the open state such that the barrier 2140 is rolled away from the body 2120 to reveal a chamber 2110 into which the consumable 2101 can be deposited. Relative movement of the barrier 2140 and body 2120 is guided by the elastic memory of the barrier 2140. In this embodiment, the chamber 2110 is a single chamber and the barrier 2140 merely acts to inhibit ingress and egress of the consumable 2101 into and out of the chamber 2110. In this embodiment, the consumable 2101 is rod shaped and comprises a longitudinal axis for alignment with the longitudinal direction Y of the aerosol provision device 2100. The shape and form of the consumable 2101 is not limited to that shown in FIG. 21*a*. FIGS. 21*a* and 21*b* further show a mouthpiece 2130 that is each fixed in position relative to the body 2120 and is discrete from the barrier 2140. In this embodiment, the mouthpiece 2130 protrudes from the body 2120 at a top of the aerosol provision device 2100, corresponding to a mouth end.

Figure 22A:
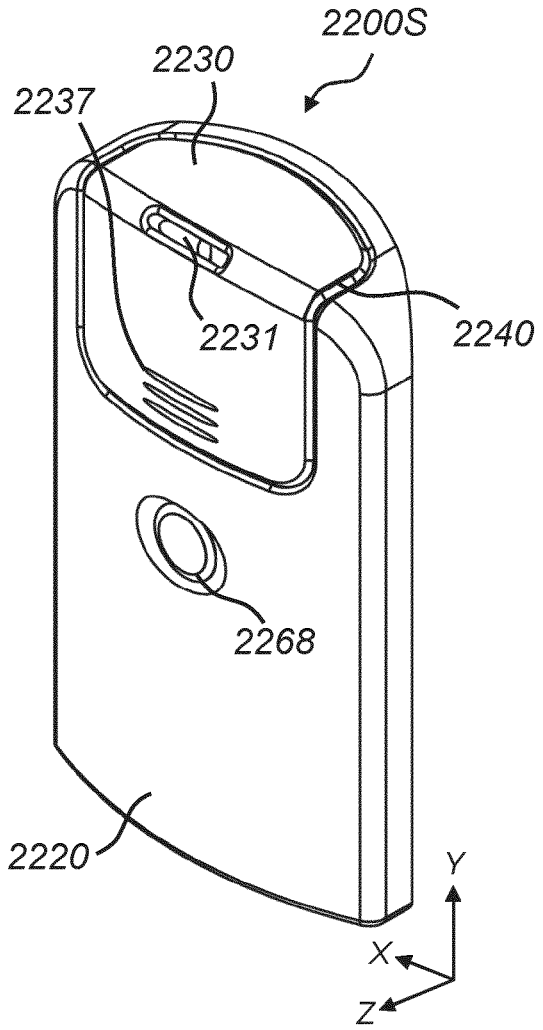
FIGS. 22*a*, 22*b*, and 22*c* each show a perspective view of an aerosol provision system.
Figure 22B:
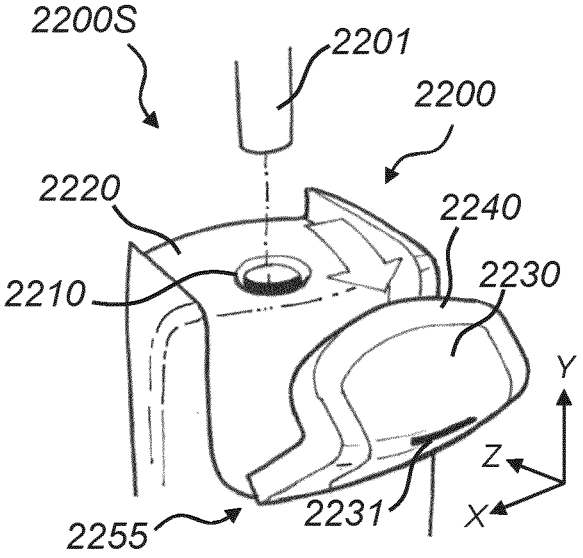
Figure 22C:
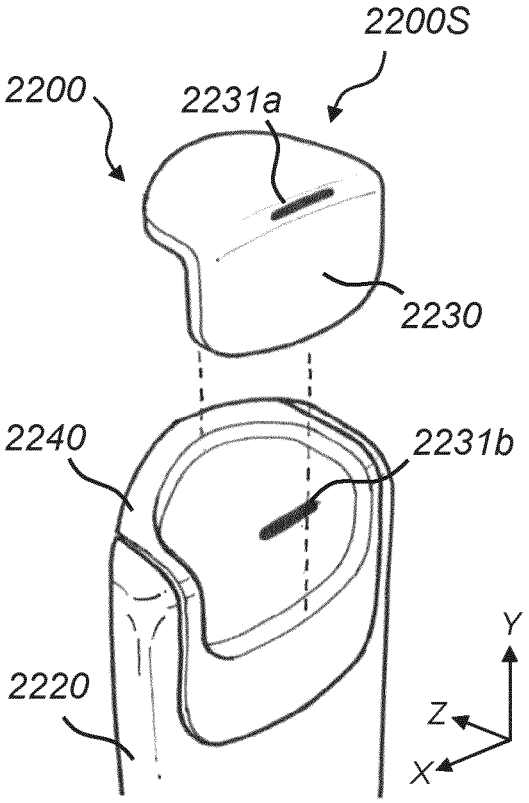

FIGS. 22*a*, 22*b* and 22*c* show an aerosol provision system 2200S comprising an aerosol provision device 2200 and a consumable 2201. In this embodiment, the consumable 2201 comprises a rod shape and is insertable into a correspondingly shaped chamber 2210 of the aerosol provision device 2200.

The aerosol provision device 2200 comprises a mouthpiece 2230 having an opening 2231*a*, and a barrier 2240 that is pivotable about a body 2220 by a pivot 2255. The barrier 2240 and mouthpiece 2230 are discrete. Both the barrier 2240 and the mouthpiece 2230 move relative to the body 2220. The mouthpiece 2230 is removably attachable to the barrier 2240. In FIG. 22*b*, the mouthpiece 2230 is shown attached to the barrier 2240. The mouthpiece 2230 is attached to an outer side of the barrier 2240. In FIG. 22*c*, the mouthpiece 2230 is removed from the outer side of the barrier 2240. The mouthpiece 2230 is positioned at a mouth end of the aerosol provision device 2200, wherein the pivot 2255 comprises an axis of rotation located away from the buccal end, as shown in FIG. 22*b*.

The aerosol provision device 2200 comprises a button 2268 to release the barrier 2240 from the body 2220 so that the consumable 2201 can be exposed and removed by the user in an open state (shown in FIG. 22*b*). The button 2268 may additionally or alternatively turn the aerosol provision device 2200 on or off to activate or enable activation of an aerosol generator. The mouthpiece 2230 is shown only in FIG. 22*a* with three gripping portions 2237 to aid gripping of the mouthpiece 2230 by the user and the subsequent removal of the mouthpiece 2230. Advantageously, it is possible to remove the mouthpiece 2230 from the barrier 2240 when the aerosol provision device 2200 is arranged in the closest state (shown in FIG. 22*c*). In other embodiments, fewer or more than seven gripping portions 2237 may be used. In some embodiments, only one gripping portion 2237 may be used. In some embodiments, the gripping portion 2237 may be formed on an outer surface of the mouthpiece 2230. In other embodiments, the gripping portion 2237 may be combined with the outer surface of the mouthpiece 2230.

Figure 23A:
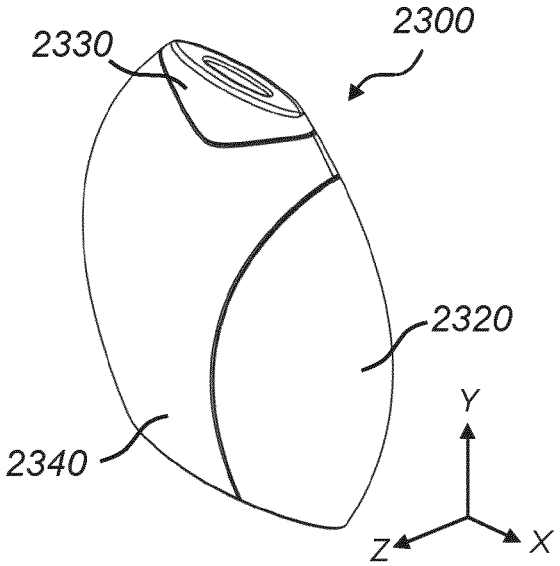
FIGS. 23*a*, 23*b*, and 23*c* each show a perspective view of an aerosol provision system.
Figure 23B:
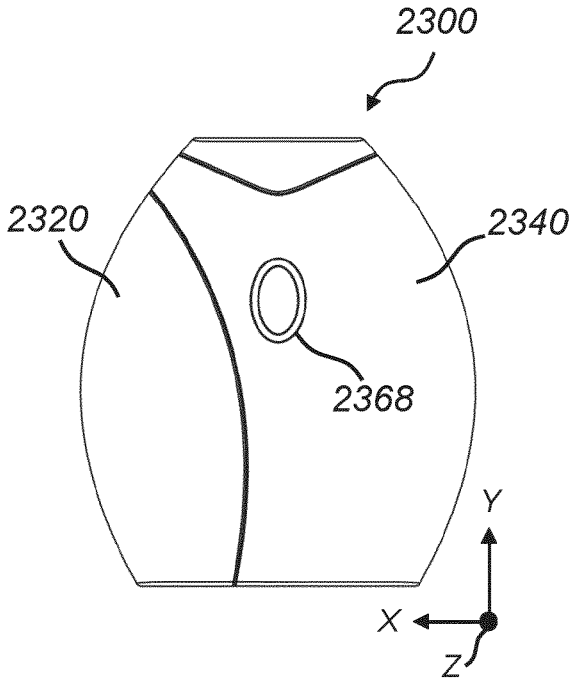
Figure 23C:
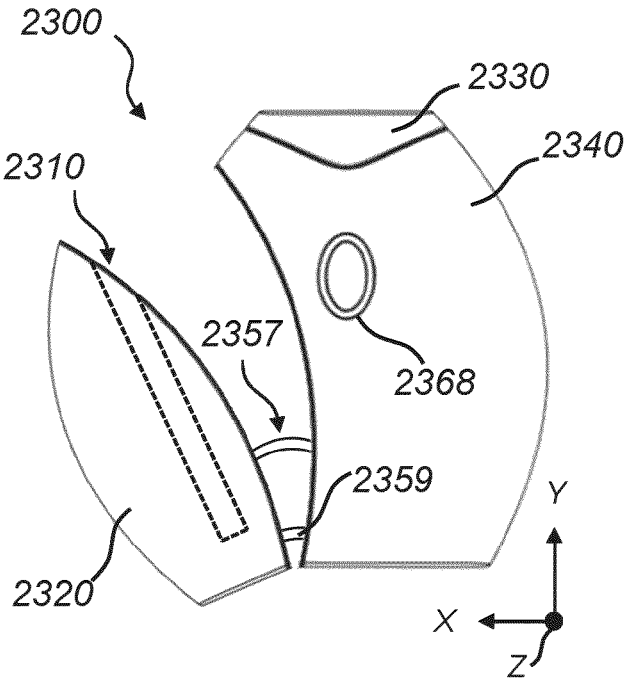

FIGS. 23*a*, 23*b* and 23*c* show an aerosol provision device 2300. In this embodiment, a barrier 2340 is discrete from the mouthpiece 2330 but is fixed in position relative to the mouthpiece 2330. The consumable 2301 comprises a rod shape and is insertable into a correspondingly shaped chamber 2310 of the aerosol provision device 2300. The aerosol provision device 2300 is arrangeable between a closed state (shown in FIGS. 23*a* and 23*b*) and an open state (shown in FIG. 23*c*). The barrier 2040 is to block a chamber 2310 into which a consumable is insertable to inhibit ingress of a consumable when inserted into the chamber 2310 and egress of the consumable from the chamber 2310. When the aerosol provision device 2300 is arranged in the open state, the barrier 2340 allows ingress and egress of the consumable relative to the chamber 2310.

The aerosol provision device 2300 comprises a button 2368 to release the barrier 2340 from the body 2320 so that the consumable can be exposed and removed by the user in the open state. The functionality of the button 2368 is the same as that described in relation to aerosol provision device 2200.

The aerosol provision device 2300 comprises a rail 2357 that allows the barrier 2340 to be translationally moveable relative to the body 2320. In this embodiment, relative movement of the barrier 2340 and the body 2320 is achieved by overcoming a first resistance to a relatively low force and then a second resistance to a relatively high force. The rail 2357 is arranged to cause the first resistance and the second resistance. This allows relative motion of the barrier 2340 and the body 2320 to vary to provide useful feedback to the user as to the current relative position and/or potential relative positions of the barrier 2340 and the body 2320. The aerosol provision device 2300 further comprises a catch 2359 to define a limit of relative movement of the barrier 2340 and the body 2320.

Although not shown, any of the aerosol provision devices previously discussed, for example aerosol provision device 100, may comprise a retention member to hold the consumable in position in the respective chamber. The retention member may help to prevent unintentional movement of the consumable. Alternatively, or additionally, a retention member may be provided to hold the respective barrier in one or both of the first and second positions. An example retention member is a protrusion of the body that is engageable with a recess of the respective barrier and/or consumable. Cooperation of the protrusion and recess may increase the force necessary to remove the barrier from the first and/or second position or the consumable from the respective chamber.

This may help to prevent unintentional movement of the barrier and/or removal of the consumable. In some embodiments, the retention member may be provided on the barrier and/or consumable when the recess is provided in the respective body. The retention member could also take the form of a magnetic attachment or an alternative mechanical fastening, such as a screw thread and threaded barrel.

Each aerosol provision device discussed herein may comprise features discussed with other aerosol provision devices (but are not shown in the figures relating to each aerosol provision device) as long as the features are compatible with the aerosol provision device. Non-exhaustive examples include a damping mechanism, a detector, a controller, a motor, an aerosol generator, a power source, and a switch.

Figure 24:
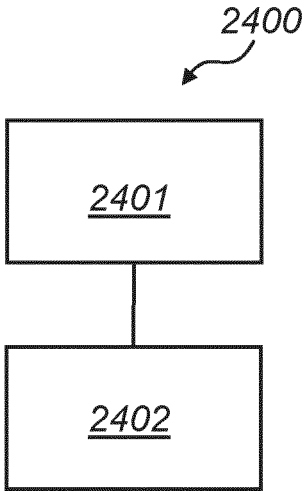
FIG. 24 shows an illustration of a method of arranging an aerosol provision device.

FIG. 24 shows an illustration of a method 2400 of arranging an aerosol provision device. The method 2400 comprises arranging the aerosol provision device in an open state 2401 by moving a barrier and a body with respect to each other to allow ingress of a consumable into at least one portion of a chamber and egress of the consumable from the at least one portion of the chamber. The method 800 comprises arranging the aerosol provision device in a closed state 2402 by moving the barrier and the body with respect to each other to inhibit the ingress and egress of the consumable.

In some embodiments, the arranging the aerosol provision device in the open state 2401 comprises moving the barrier by electronic or electro-mechanical operation of the barrier by a controller of the aerosol provision device. In some embodiments, the arranging the aerosol provision device in a closed state 2402 comprises moving the barrier by electronic or electro-mechanical operation of the barrier by a controller of the aerosol provision device.

The aerosol provision devices as previously described, can be used, where discussed, in the operation of the method 2400.

Embodiments of the present invention comprise an aerosol provision device, aerosol provision systems comprising an aerosol provision device and a consumable comprising aerosol-generating material, and a method of arranging an aerosol provision device. The consumable is for receipt in the chamber of the aerosol provision device. In use, the aerosol provision device is configured to generate an inhalable medium, such as aerosol, from the aerosol-generating material.

For the avoidance of doubt, where in this specification the term "comprises" is used in defining the invention or features of the invention, embodiments are also disclosed in which the invention or feature can be defined using the terms "consists essentially of" or "consists of" in place of "comprises". Reference to a material "comprising" certain features means that those features are included in, contained in, or held within the material.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The various embodiments described herein are presented only to assist in understanding and teaching the claimed features. These embodiments are provided as a representative sample of embodiments only and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized, and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An aerosol provision device comprising:

a chamber configured to receive a consumable comprising aerosol-generating material, the chamber comprising an opening;

a body comprising at least one portion of the chamber;

a mouthpiece through which aerosol generated from the aerosol-generating material is drawn by a user of the aerosol provision device; and a barrier discrete from the mouthpiece and movably coupled to the body;

wherein, when the aerosol provision device is arranged in a closed state, the barrier inhibits ingress of the consumable into the at least one portion of the chamber and egress of the consumable from the at least one portion of the chamber, and, when the aerosol provision device is arranged in an open state, the barrier allows ingress of the consumable into the at least one portion of the chamber and egress of the consumable from the at least one portion of the chamber;

wherein a portion of the opening of the chamber is exposed when the barrier is in the closed state.

2. The aerosol provision device according to claim 1, wherein the barrier is movable with respect to the mouthpiece, such that, when the aerosol provision device is arranged in the closed state, the barrier is in a first position with respect to the mouthpiece, and, when the aerosol provision device is arranged in the open state, the barrier is in a second, different position with respect to the mouthpiece.

3. The aerosol provision device according to claim 1, wherein the mouthpiece is removably attachable to the barrier.

4. The aerosol provision device according to claim 1, wherein the barrier comprises another portion of the chamber.

5. The aerosol provision device according to claim 1, wherein the barrier is rotationally moveable relative to the body.

6. The aerosol provision device according to claim 1, wherein the barrier is translationally moveable relative to the body.

7. The aerosol provision device according to claim 6, wherein the translational motion comprises curvilinear motion.

8. The aerosol provision device according to claim 1, wherein the barrier is helically moveable relative to the body.

9. The aerosol provision device according to claim 1, wherein the aerosol provision device comprises a guide to guide movement of the barrier relative to the body in a predetermined manner.

10. The aerosol provision device according to claim 1, wherein the aerosol provision device comprises a driving mechanism configured to drive relative movement of the barrier and the body.

11. The aerosol provision device according to claim 1, wherein the aerosol provision device comprises a damping mechanism configured to control at least a portion of relative movement of the barrier and the body.

12. The aerosol provision device according to claim 1, wherein the barrier is a flexible member.

13. The aerosol provision device according to claim 1, wherein the barrier comprises an opening through which at least one portion of the body is configured to pass during movement of the aerosol provision device between the closed state and the open state.

14. The aerosol provision device according to claim 13, wherein the barrier itself is configured to partially block the opening when the aerosol provision device is arranged in the closed state.

15. The aerosol provision device according to claim 1, wherein the aerosol provision device comprises a longitudinal direction, and wherein relative movement of the barrier and the body is substantially parallel to the longitudinal direction.

16. The aerosol provision device according to claim 1, wherein the barrier comprises a first part and second part that are movable relative each other.

17. The aerosol provision device according to claim 1, wherein relative movement of the barrier and the body is achieved by overcoming a first resistance to a relatively low force and then a second resistance to a relatively high force.

18. An aerosol provision system comprising:

the aerosol provision device according to claim 1; and the consumable comprising the aerosol-generating material, the consumable configured for receipt in the at least one portion of the chamber of the aerosol provision device;

wherein, in use, the aerosol provision device is configured to generate an aerosol from the aerosol-generating material.

* * * * *